US006047416A

United States Patent [19]

Carrier

[11] Patent Number: 6,047,416

[45] Date of Patent: Apr. 11, 2000

[54] THERAPEUTIC SHOWER FOR ENVELOPING PURPOSES

[75] Inventor: Denis Carrier, Levis, Canada

[73] Assignee: Denis Carrier, Canada

[21] Appl. No.: 09/053,787

[22] Filed: Apr. 2, 1998

[51] Int. Cl.[7] ..... A47K 3/22

[52] U.S. Cl. ..... 4/596; 4/601; 4/613

[58] Field of Search ..... 4/601, 613, 596, 4/900; 239/263

[56] References Cited

U.S. PATENT DOCUMENTS

| | | | |
|---|---|---|---|
| 2,336,402 | 12/1943 | Kaiser | 4/601 |
| 3,551,918 | 1/1971 | Bergmark | 4/613 |
| 3,772,714 | 11/1973 | Sealby et al. | 4/601 |
| 4,724,553 | 2/1988 | Bianchi | 4/601 |
| 4,895,307 | 1/1990 | Swinehart et al. | 239/263.1 |
| 5,070,549 | 12/1991 | Campe | 4/596 |
| 5,418,985 | 5/1995 | Antoine | 4/601 |
| 5,865,374 | 2/1999 | Barta et al. | 239/263.1 |

*Primary Examiner*—Charles R. Eloshway

[57] ABSTRACT

In a shower device designed to carry out a complete and constant 360-degree therapeutic sweeping of the user's body, water is sprayed from a shower head and a series of holes in tubes along the space provided for use as a shower stall. These tubes are connected together by a rotary air and water servomechanism revolving around a vertical water supply axis. The holes are positioned to direct the sprays of water toward the centre of the shower stall. The rotary servomechanism is driven by a motor, and the servomechanism induces the circular movement of the tubes around the shower stall, and this movement combines with the water spray action from the tubes to provide the therapeutic coverage of the user's body in the space at the center of the shower stall. To dry off following a shower, users may switch over to sprays of warm air from the same tubes by activating a drying control.

5 Claims, 7 Drawing Sheets

THERAPEUTIC SHOWER FOR ENVELOPING PURPOSES

BACKGROUND OF THE INVENTION

As stated in Bianchi, "The benefits of massage on the human body are well known and it is also known that, in order to enjoy such benefits without having to resort to an expert masseur, it has recently become a diffused practice to undergo a hydromassage, this being a massage performed with liquid streams".

On currently available devices however, several weaknesses can be observed in terms of complete user body coverage, thermal variations around the user body, and also with regards to related drying systems. These observed weaknesses lead one to conclude that the therapeutic properties of the current shower devices can be substantially improved. User's needs are therefore only partially met. Drying systems, twinned or integrated into the shower device, do exist, however none of these systems provide a specifically therapeutic effect that can be added to the effects of a multiple jet system.

A certain number of shower devices are currently known and available on the market, and several patents have drawn our attention. More specifically, the apparatus of Bianchi 4,724,553 proposes a shower device offering a continuous hydromassage but only in one direction, leaving an area of the body uncovered by water or air at any given time.

Several other inventions aim at offering a therapeutic effect on the body (Fohran 2,536,656, Immel 2,341,604, Antoine 5,418,985, Knapp 4,544,690, Hiraishi 5,428,850, Sieth 5,299,743) but by their very design cannot offer the overall therapeutic effect that is sought here, because they do not allow for a complete and continuous coverage of the whole user body. Fohran 2,536,656 proposes a hydrotherapy device for human body members, therefore not allowing it to cover the whole body and create the desired overall therapeutic effect.

SUMMARY OF THE INVENTION

The system proposed by Bianchi covers only one side of the body at a given time, whereas the present invention offers a complete and continuous coverage of the body over a 360-degree angle. This feature allows the device of the present invention to solve the problems and limitations inherent to the currently available systems in regards to complete coverage of the user's body and related therapeutic effects.

The system of multiple jets directed towards the space provided for use, coming from the tubes going downward or upward depending if the rotary servomechanism is position at the top or at the bottom of the device, allows for a complete and continuous sweeping of the periphery of the user's body with water jets. The addition of a shower head in the upper part of the shower device completes the body coverage by water jets. Thanks to this constant sweeping of the periphery of the user's body, the said user does not feel any variation in temperature created by the presence of air spaces not covered by any water jets. Moreover, an air extraction system placed in the upper part of the shower device, allows for fast evacuation of hot moist air and for an increased circulation of ambient air, hence additionally contributing to the comfort of the user. The present invention's device is also equipped with a drying system which uses the same conduits as those used for the feeding of the water jets, but this time to produce hot air jets. The user can switch from the shower stage to a drying stage offering similar therapeutic and enveloping effects, the rotation and orientation principle remaining the same.

DETAILED SPECIFICATION

Figure 1:
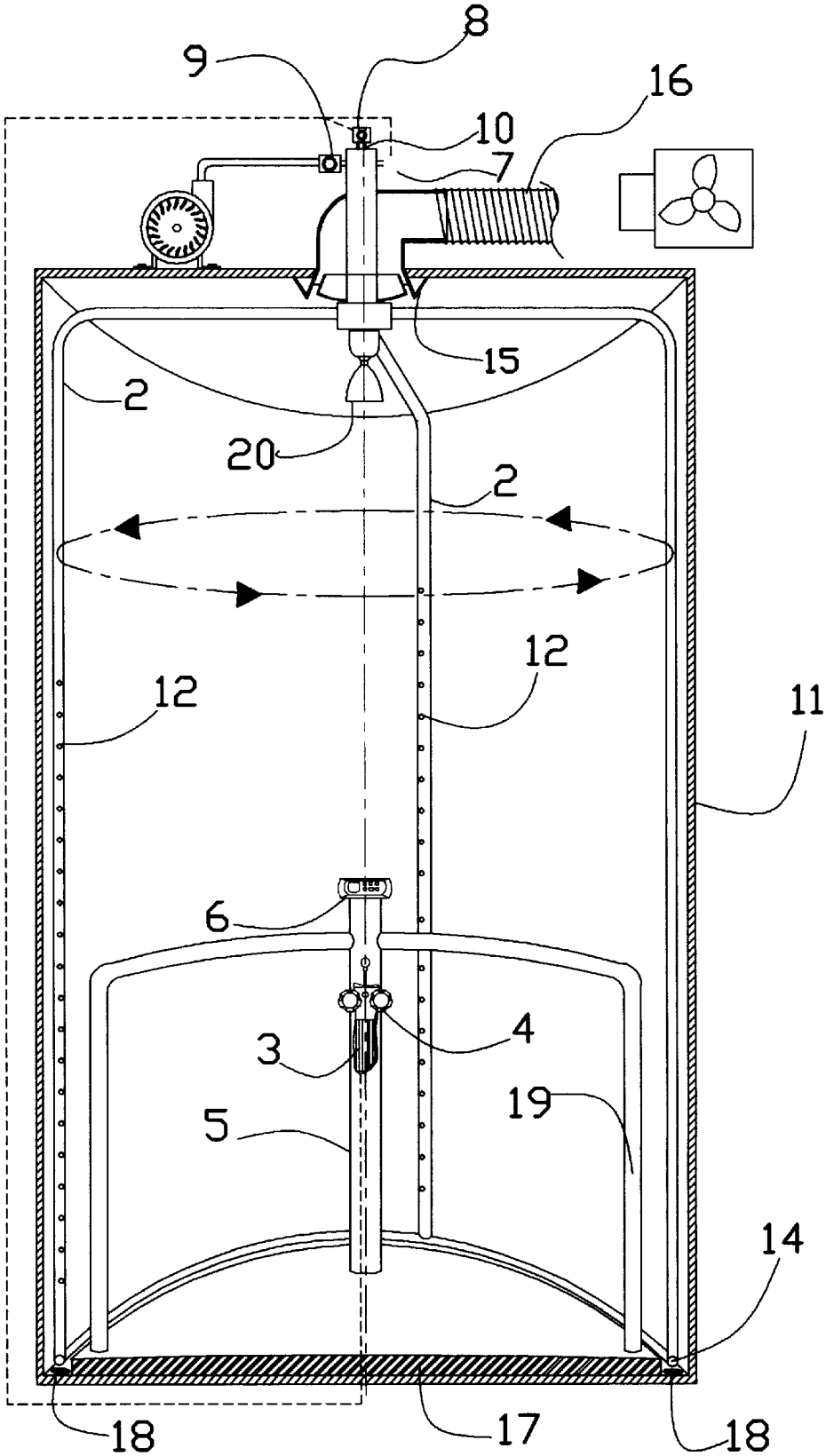
FIG. 1 shows a general view in elevation of the shower device assembly.
Figure 2:
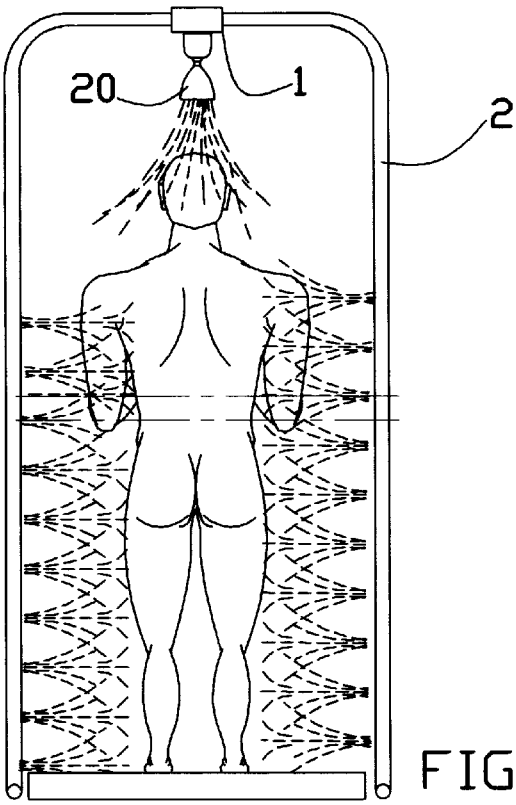
FIG. 2 shows a view in elevation of the projected water jets, coming from straight or arched tubes.
Figure 3:
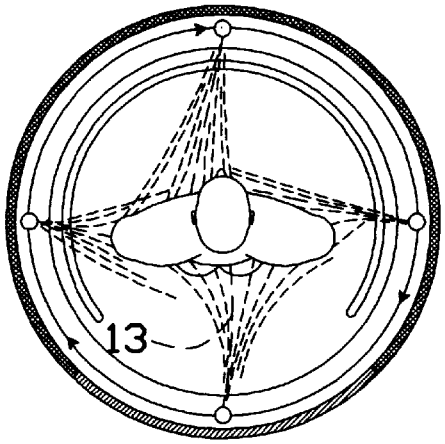
FIG. 3 shows a view in plan of the projected water jets, coming either from four straight tubes, or from five arched tubes.
Figure 2A:
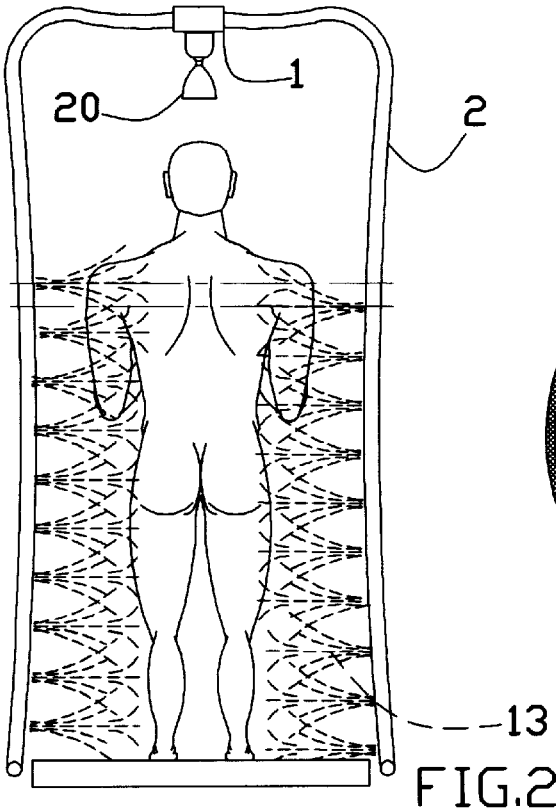
Figure 3A:
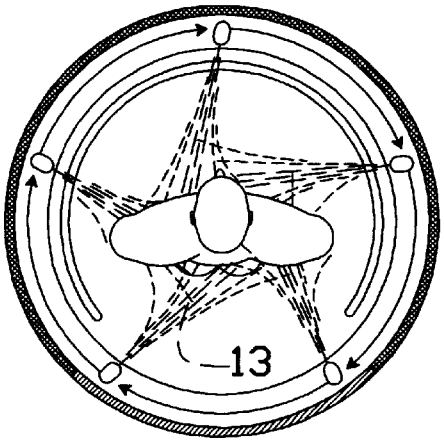

As shown on FIGS. 1, 2 and 3, the shower device comprises a rotary servomechanism for water and air 1 on which a certain number of tubes 2 are connected. Hot and cold water are being supplied through two separated piping systems 3 inside a central column 5, on which tap 4 and system controls 6 are located to adjust the water temperature before the said water flows towards the upper portion of the device where solenoid valves 7, 8, 9 are installed. From this point, the water is directed toward the rotary servomechanism 1 and the supply pipe 10 of the shower head 20. The water being directed toward the rotary servomechanism 1 is then supplied to the tubes 2 which are descending along the device's walls 11 and around the space provided for use. The water supplied to the tubes 2 is then projected towards the center of the device through several holes 12 bored along the length of each tube 2, these holes being shifted lengthwise from one tube to the other in order to increase the coverage of the user's body.

The said holes 12 can be fitted with nozzles, allowing for a variety of spray patterns and intensity. The tubes 2 can be straight or arched, in order to compensate for the force exerted on the tubes 2 by the spray jets. A ring 14 can be fixed to the ends of the tubes 2 to ensure a precise rotation movement and to prevent the tubes 2 from being pushed on the shower wall 11 by the force resulting from the spray jets.

At the top of the device, an air extraction system 15 is located around the rotary servomechanism, to allow for the removal of the hot humid air, towards an extraction duct 16, the lid of the said system 15 being fixed in order to let sufficient space to ensure efficient air removal. The opening of the extraction system 15 is located directly on an opening made in the upper part of the shower roof.

Figure 4:
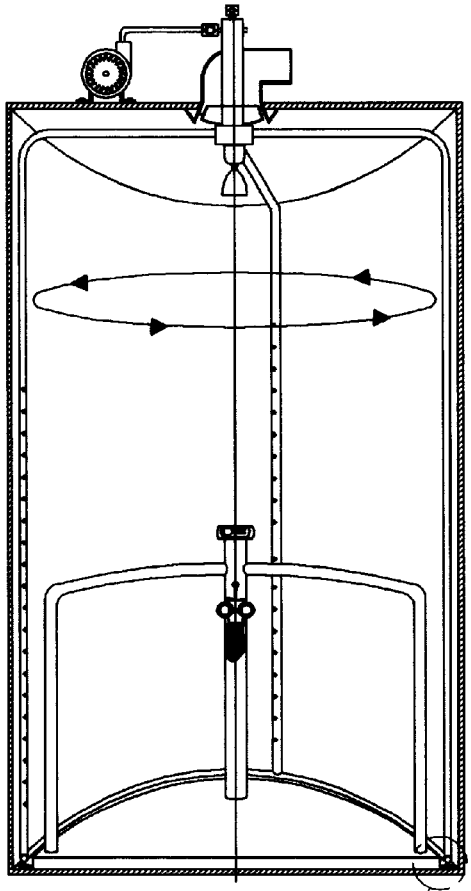
FIG. 4 shows an enlarged view of the lower part of the shower device
Figure 4A:
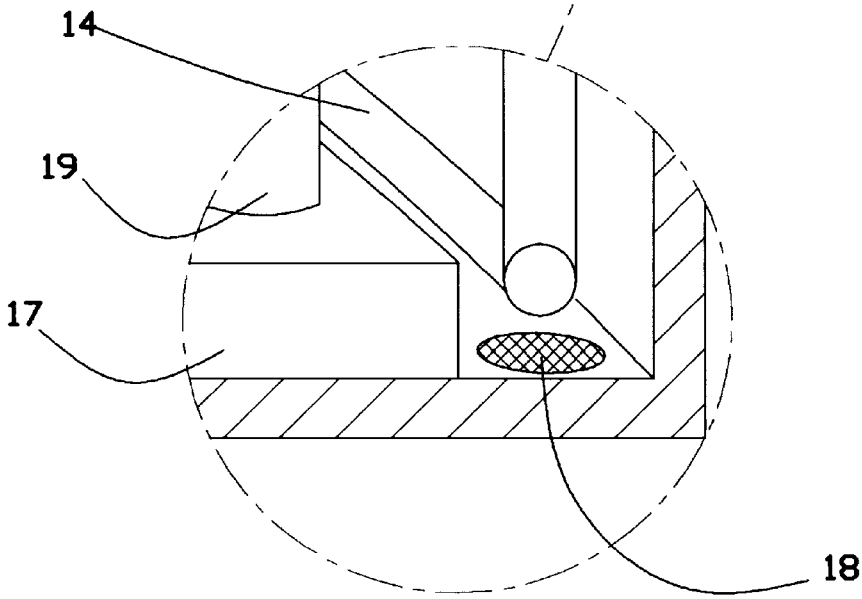

As shown on FIGS. 1 and 4, a base 17 of circular and convex form is located at the center bottom of the shower. The base allows for proper drainage of the water towards peripherial drains 18, and also precise guiding of the tubes 2 while they are rotating. The adjacent space around the base allows the tubes 2 to move freely around the base. A guard 19 having a smaller diameter that the base 17 itself, and which integrates the central column 5, is fixed to the base 17 with both ending extremities of the guard 19 being sufficienly separated for the user to easily take place within the shower.

Figure 5:
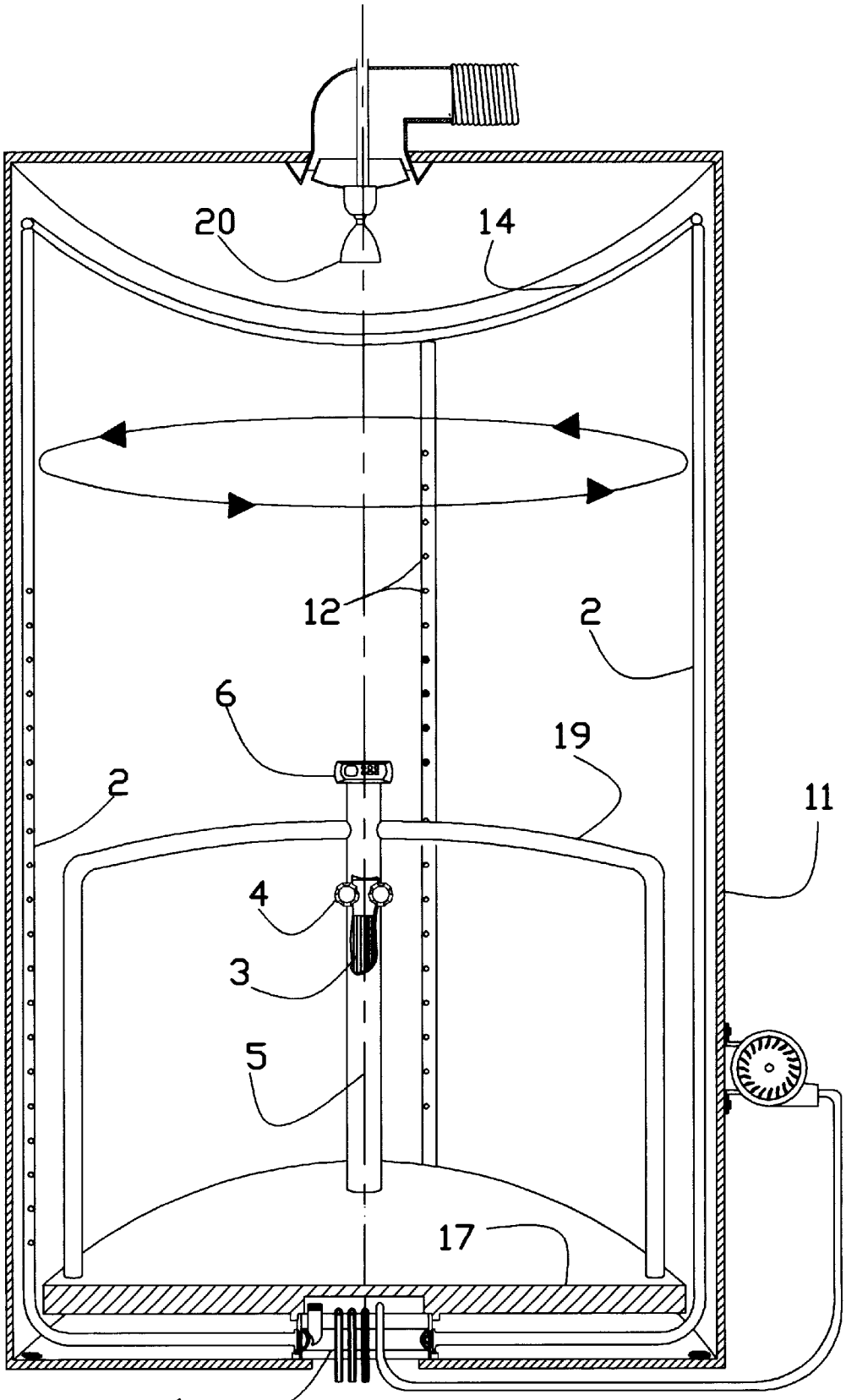
FIG. 5 shows a general view in elevation of the device, with the rotation servomechanism located under the shower device base.

As shown on FIG. 5, the system can be completely reversed, the rotary servomechanism 1 being located under the base 17, with the tubes 2 going upwards along the shower walls 11, and the shower head 20 remaining at its initial location.

Figure 6:
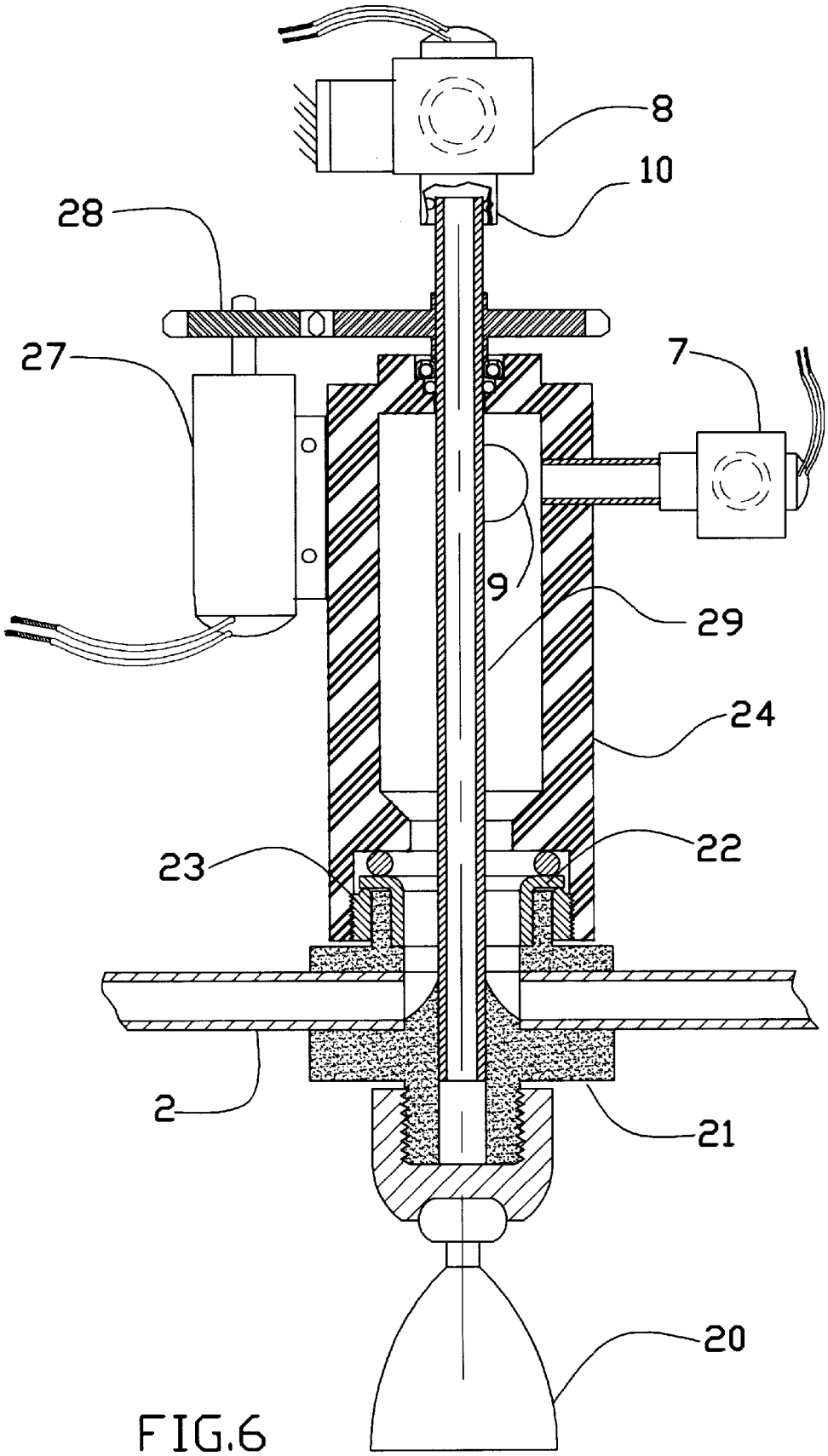
FIG. 6 shows a transversal cut view of the rotary servomechanism.

FIG. 6 shows the details of a preferred variation of the rotary servomechanism. The tubes 2 are connected to a multiple connection housing 21. A threaded ring 23 is freely located around the upper neck of the housing 21 and a shouldered sleeve 22 is then press-fitted inside the upper neck of the housing 21. The housing 21 is then fixed into a vertical axis pipe 24 using the threaded ring 23. A water supply pipe 29 is inserted in the connection of the shower head solenoid valve 8. The said pipe 29 goes through the vertical axis pipe 24, is supported in its rotating movement at the upper end of the vertical axis pipe 24, and goes down to end up press-fitted in the multiple connection housing 21. The water supply pipe 29 is coupled to a transmission system 28, which in turn is brought to motion using a motor 27. When the motor 27 is activated, rotating power is transmitted to the multiple connection housing 21 through the water supply pipe 29, and eventually to the tubes 2 around the user. Water intended to feed the tubes 2 comes through the solenoid valve 7, passes in the vertical axis pipe 24, then through the multiple connection housing 21 to finally end up in the tubes 2. Water intended for the shower head is delivered through the upper solenoid valve 8, through the water supply pipe 29, in the heart of the multiple connection housing 21, and finally to the head itself 20, which is fixed to the lowest part of the housing 21. When the user gets to the drying stage, hot air is supplied to another valve 9, and the air uses the same path as the water intended for the tubes 2.

Figure 7:
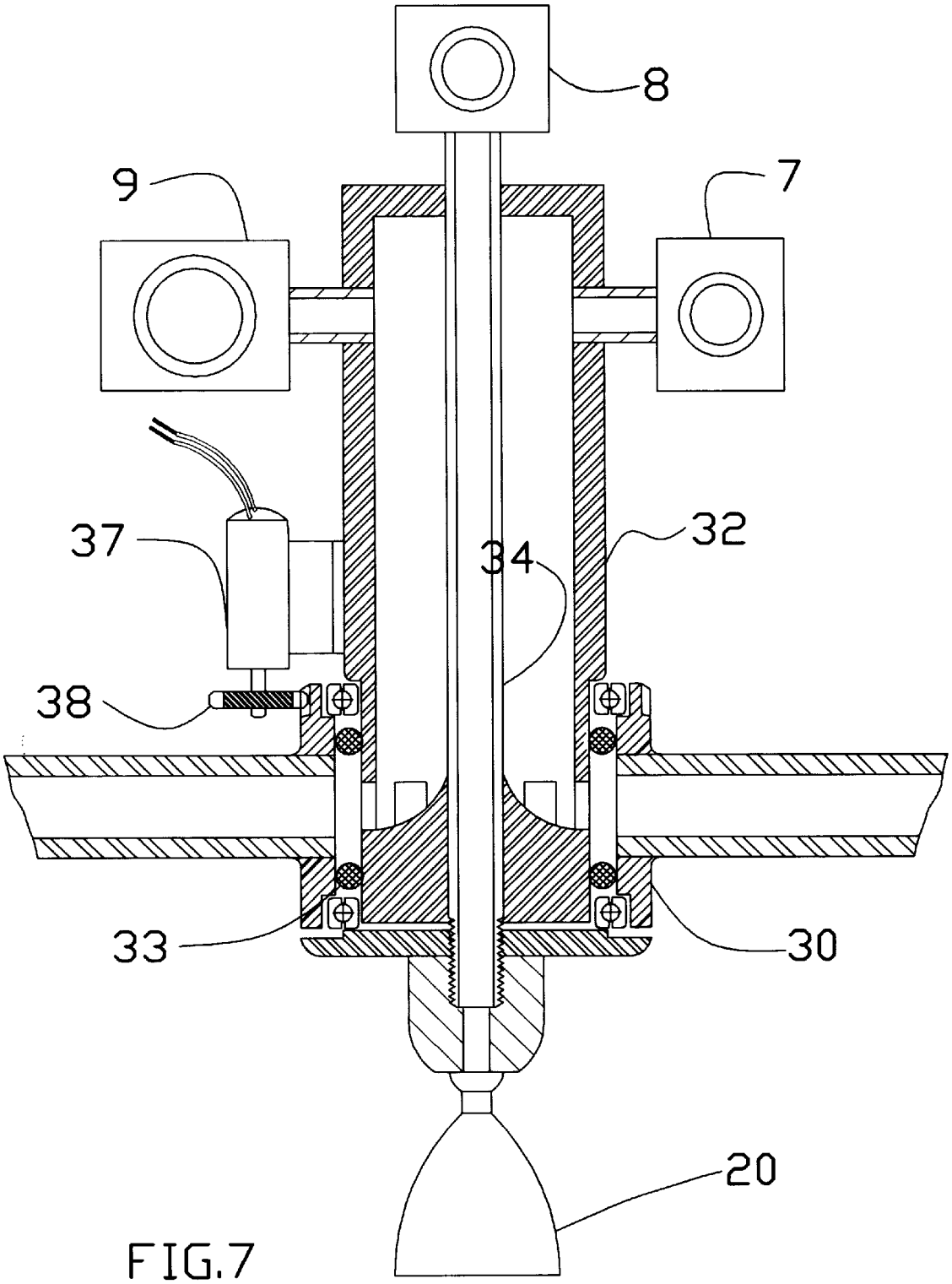
FIG. 7 shows a variation of the rotary servomechanism.

FIG. 7 shows a different version of the rotary servomechanism, when the water and the air use the same path as in the version described on FIG. 6, but the rotating movement of the tubes is induced with a different multiple connection housing 30, which is directly linked to a motor 37 with a simpler transmission system 38. The water supply pipe 34, the shower head 20 and the vertical axis pipe are fixed, and adequate sealing between the axis pipe 32 and the housing 30 is ensured with sealing rings 33.

Figure 8:
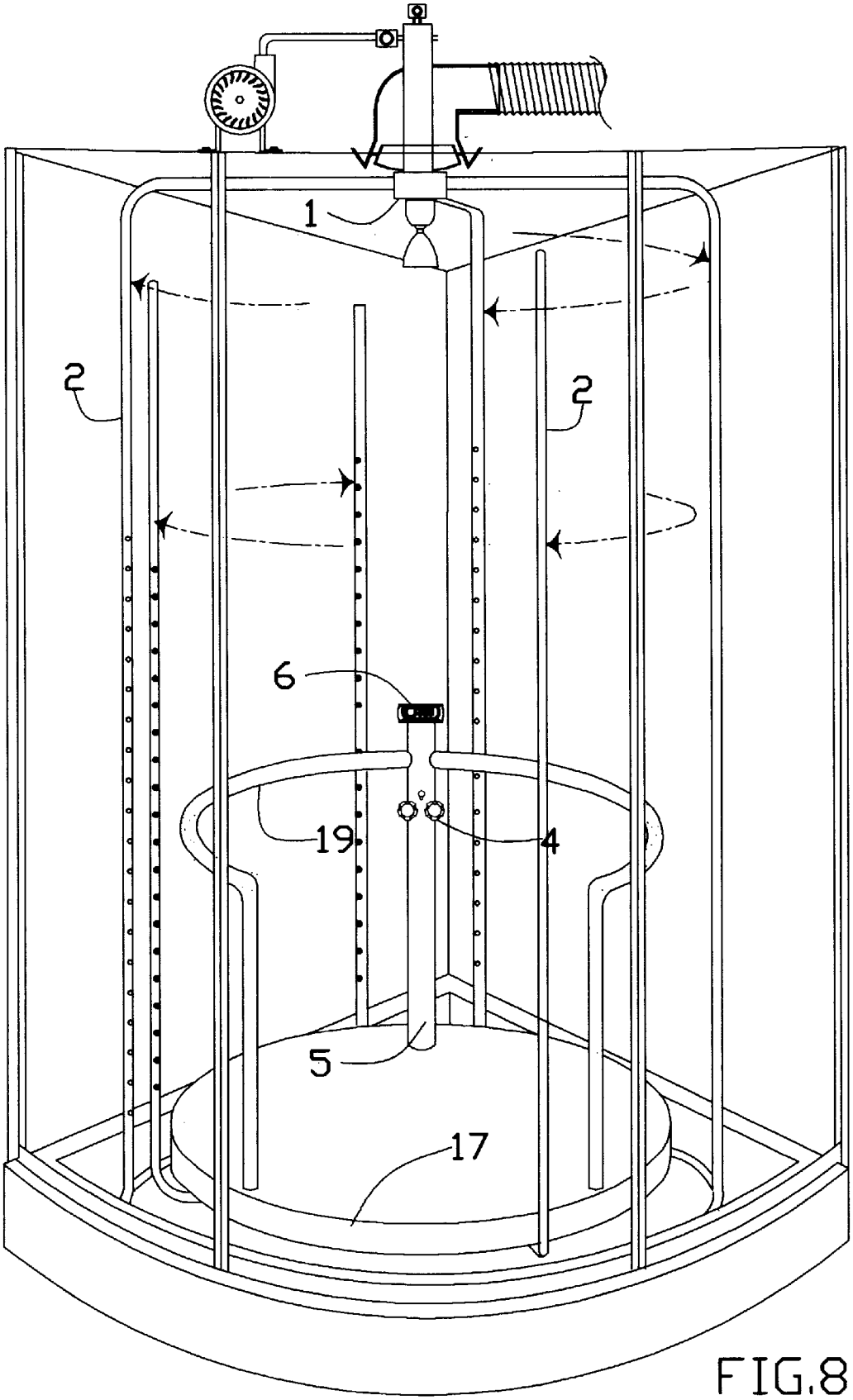
FIG. 8 shows a view in elevation of a combination of a servomechanism located both in the upper part and the lower part of the device.

FIG. 8 shows a version of the device equipped with a rotary servomechanism both in the upper part and the lower part of the device, the two servomechanism observing a contrary rotation movement, therefore enhancing the enveloping effect of the device.

This best mode for carrying out the invention, in conjunction with the referred figures, is given as a descriptive indication and is by no means restrictive with respect to any modifications that could be brought to the invention, provided that these are deemed as still being part of the framework of the disclosure.

I claim:

1. A therapeutic enveloping shower comprising:

a shower enclosure;

a water supply pipe arranged on an upper portion of the shower enclosure;

a multiple connection fitting connected to one end of the water supply pipe;

a plurality of vertical spray arms attached to the multiple connection fitting in spaced relation to one another and in fluid communication with the water supply pipe, the spray arms being located interiorly of the shower enclosure and arranged therein so as to substantially surround a user positioned within the enclosure, each spray arm defining a separate vertical plane and containing a plurality of nozzles;

a motor operatively associated with the other end of the water supply pipe to turn the water supply pipe, multiple connection fitting, and vertical spray arms; and means for supplying water from a water source to the water supply pipe, spray arms, and nozzles;

whereby, water from the nozzles impacts the user along separate vertical planes corresponding to those defined by the spray arms as the arms are rotated about the user, such that the user is constantly substantially enveloped by sprayed water.

2. A therapeutic enveloping shower as in claim 1, further including means for supplying hot air to said spray arms and nozzles.

3. A therapeutic enveloping shower as in claim 1, further including an air extraction system for extracting hot humid air from the shower enclosure.

4. A therapeutic enveloping shower as in claim 1, the shower enclosure further including a convex base with a peripheral drain for draining water from the central, user-occupying region of the enclosure toward the periphery thereof.

5. A therapeutic enveloping shower as in claim 1, further including a user control column located substantially centrally of the enclosure interior, the control column having means for controlling the supply of water to the water supply pipe, spray arms, and nozzles and means for controlling the temperature of the water.

* * * * *